United States Patent [19]

Ishiwatari

[11] Patent Number: 4,482,071

[45] Date of Patent: Nov. 13, 1984

[54] SEALING AID FOR FASTENING A RESILIENT PLUG INSERTED INTO AN OPENING OF A CONTAINER

[75] Inventor: Shiro Ishiwatari, Hino, Japan

[73] Assignee: Olympus Optical Co., Ltd., Japan

[21] Appl. No.: 434,107

[22] Filed: Oct. 13, 1982

[30] Foreign Application Priority Data

Oct. 16, 1981 [JP] Japan ..... 56-153657

[51] Int. Cl.[3] ..... B65D 41/42

[52] U.S. Cl. ..... 215/255; 215/251

[58] Field of Search ..... 215/249, 251, 255

[56] References Cited

U.S. PATENT DOCUMENTS 3,480,171 11/1969 Rohde ..... 215/251

3,547,297 12/1970 Herbert ..... 215/249

*Primary Examiner*—Donald F. Norton

*Attorney, Agent, or Firm*—Parkhurst & Oliff

[57] ABSTRACT

A rubber plug is inserted into a opening of a neck portion of container airtightly and is covered with a seal cap made of an aluminum thin plate. The seal cap has slit-like cutout lines along which the seal cap is to be separated into two halves and is covered with an outer cap made of elastic material. The seal cap is connected to the outer cap at one or two positions. Therefore, the seal cap can be removed from the container by one operation of pulling-up the outer cap, and it is possible to reduce an injury caused by the seal cap.

4 Claims, 6 Drawing Figures

SEALING AID FOR FASTENING A RESILIENT PLUG INSERTED INTO AN OPENING OF A CONTAINER

BACKGROUND OF THE INVENTION

The present invention relates to a sealing aid for fastening tightly a rubber plug inserted into an opening of a neck portion of a container for containing liquid, particle, powder or gas substance.

In clinical, chemical and pharmaceutical fields, an amount of reagent for use in an automatic chemical analyzer or a human injection is very small, and thus it is necessary to seal an accurate amount of reagent into a container quantitatively. Usually, a rubber plug is used to clog an opening formed in a neck portion of the container in order to protect the reagent against leakage, deterioration or modification due to exposure with air. Moreover, the plug is covered with a seal cap made of a thin aluminum plate which is bent to correspond with an outer contour of the neck portion in order to prevent the rubber plug from being removed from the container and prevent any loss of airtightness of the container due to an elastic recovery force of the rubber plug during transportation of the container. The seal cap also functions to show the amount of unused reagent contained in the container.

FIG. 1 is a perspective view showing a conventional container with the known seal cap mentioned above. In FIG. 1, a rubber plug (not shown) is inserted into an opening formed in a neck portion of a reagent container 1 forming an airtight container. In addition, the rubber plug is covered with a seal cap 2 made of a thin aluminum plate. A peripheral portion of the seal cap 2 is bent to correspond with an outer contour of a flange provided at a top of a neck portion 4 of the container so as to fix the seal cap 2 to the container 1. In such a construction, the seal cap 2 functions to prevent the rubber plug from being detached due to an elastic recovery force thereof. As shown in FIG. 1, the seal cap 2 has slit-like cutout portions 3 which are aligned with a broken line which extends over the upper and side surfaces of the seal cap 2. The cutout portions 3 function to separate the seal cap 2 into two halves, so that the seal cap 2 can be easily removed from the container 1.

In order to remove the seal cap 2, the tip portion of tweezers or a driver is first inserted into the cutout portion 3 so as to pry up a central tongue portion b of the seal cap 2. Then, connections 5 of the seal cap 2 are broken so that the tongue portion 6 can be elevated above the seal cap 2. The raised tongue portion 6 is further pulled up by means of the fingers so as to remove it from the container 1. After that, the remaining portion of the cap 2 is removed from the neck portion 4 by means of the fingers. As mentioned above, in order to remove the seal cap 2 from the reagent container 1, a special tool such as tweezers or a driver is required. A fairly long time for removing the cap is also necesssary. Moreover, since the human fingers are used for pulling up the tongue portion 6, the fingers are liable to be injured, particularly since the seal cap 2 is made of a thin plate of aluminum having a sharp edge and a cut surface with connections 5 having a saw-tooth shape. The cap as taught by the prior art leads to many wounded fingers.

SUMMARY OF THE INVENTION

The present invention has for its object the elimination of the drawbacks mentioned above and the provision of a sealing aid for fastening an elastic plug inserted into an opening of a container, in which a seal cap can be easily removed without using a special tool by means of the fingers without injuring the fingers.

According to the invention, a sealing aid for fastening an elastic plug inserted into an opening of a container having a neck portion and a main body connected to the neck portion comprises:

a seal cap means made of relatively hard material and being connectable to the neck portion of the container so as to cover the plug to prevent the plug from being removed from the container; and an outer cap means made of elastic material and connected partially to said seal cap means, said outer cap means covering the seal cap means;

whereby when the outer cap means is removed from the container, at least a part of the seal cap means is removed from the container together with the outer cap means.

DESCRIPTION OF THE PREFERRED EMBODIMENTS

Figure 1:
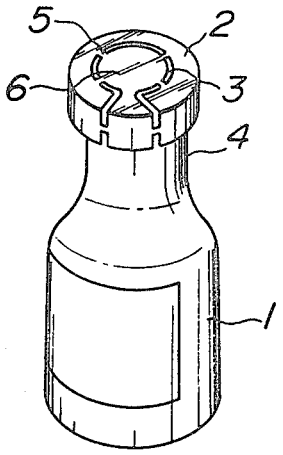
FIG. 1 PRIOR ART
FIG. 1 is a perspective view showing a conventional container with a seal cap.
Figure 2A:
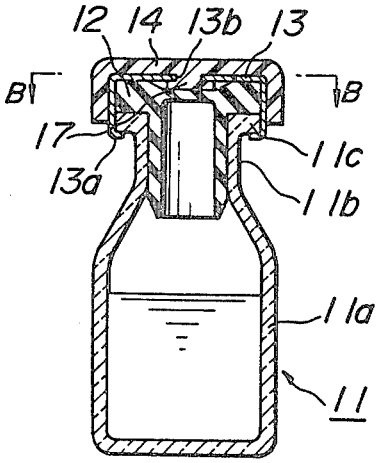
FIG. 2A is a cross sectional view illustrating one embodiment of the sealing aid according to the invention and FIG. 2B is a cross section cut along a line B—B shown in FIG. 2A.
Figure 2B:
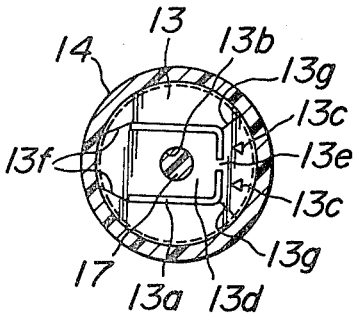
Figure 3:
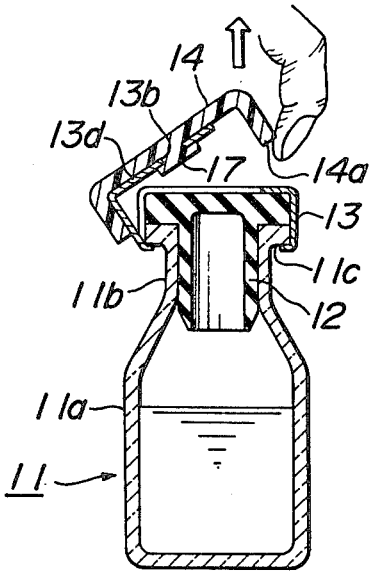
FIG. 3 is a cross sectional view depicting an operation for removing the sealing aid shown in FIGS. 2A and 2B.

FIGS. 2A and 2B are cross sectional views showing an embodiment of the sealing aid according to the invention, and FIG. 3 is a cross sectional view depicting a manner of removing the sealing aid shown in FIGS. 2A and 2B. In FIG. 2A, a predetermined amount of a reagent solution is contained in a main body 11*a* of a container 11. A plug 12 made of elastic material such as rubber is inserted into an opening formed in a neck portion 11*b* of the container 11. Moreover, the rubber plug 12 is covered with a seal cap 13 made of a thin plate of light metal such as aluminum or a hard plastic thin plate, and a peripheral portion of the seal cap 2 is bent to correspond with an outer contour of a flange 11*c* of the neck portion 11*b* of container 11 so as to fix the seal cap 13 to the container 11. In the seal cap 13 there are formed ridge-like projections 13*a* along which the seal cap 13 can be separated by pulling a center portion apart from an outer edge as will be explained later. The construction so far explained is similar to that shown in FIG. 1.

According to the invention, the seal cap 13 is further covered with an outer cap 14 made of elastic material such as synthetic resin. The outer cap 14 is connected to the seal cap 13 at a center thereof. To this end, a hole 13*b* is formed in the seal cap 13 at its center and the outer cap 14 is coupled with a disc 17 made of the same material as that of the outer cap 14 by means of the center hole 13*b*. It should be noted that the seal cap 13 and the outer cap 14 may be coupled with each other into an integral body by means of a conventional heating treatment prior to securing the caps 13 and 14 to the container 11. The outer cap 14 may be made of opaque, translucent or transparent material, and is preferably made of transparent material. In such a construction, Δ marks 13*c* formed in the seal cap 13 for indicating a direction from which the outer cap 14 is to be pulled up can be seen through the outer cap 14, and thus a user can easily find the position on the outer cap 14 upon which to place his finger. Moreover, it is a matter of course that a part of the outer cap 14 may be formed from transparent material, if necessary. Further, in case of using the opaque outer cap 14, the indication marks may be formed on the outer cap 14.

Now the operation for removing the sealing aid will be explained with reference to FIG. 3. Usually, a user gets the reagent container in the sealed state shown in FIG. 2A, and, if the sealing aid has been removed, the seal cap and outer cap are no longer secured to the container In FIG. 3, the container 11 can be held in one hand while the outer cap 14 is pulled up as shown by an arrow with a finger of the other hand by putting the finger upon a peripheral portion 14*a* of the outer cap 14 indicated by, for example, the Δ marks 13*c*. Then a tongue portion 13*d* of the seal cap 13 surrounded by the ridge-like projections 13*a* can be gradually raised up according to the pulling-up operation of the outer cap 14. Then, a connection 13*e* between the projections 13*a* is broken and the tongue center or portion 13*d* is separated from the outer portion along the projections 13*a* and depressed lines 13*f*. When the outer cap 14 is further pulled up, the outer cap 14 and tongue portion 13*d* can be removed from the container 11. The remaining portion of the seal cap 13 can be easily removed from the container 11 with the aid of depressed lines 13*g*. In this case, since the finger is in touch only with the outer cap 14 made of elastic material, there is no chance of injury from the cut edges of the thin aluminum plate constituting the seal cap 13. Moreover, since the connection 13*e* of the seal cap 13 is broken during to pulling-up operation of the outer cap 14, it is not necessary to use any special tool such as tweezers or a driver to further break the seal.

Figure 4:
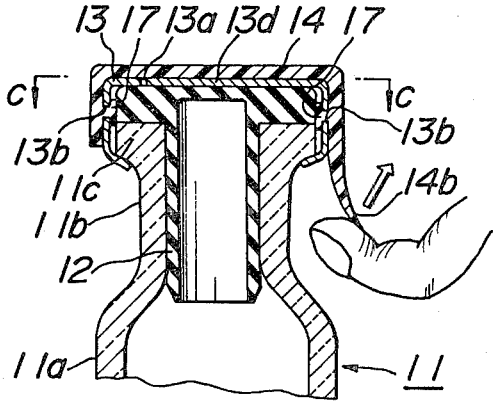
FIG. 4 is a cross sectional view showing another embodiment of the sealing aid according to the invention.
Figure 5:
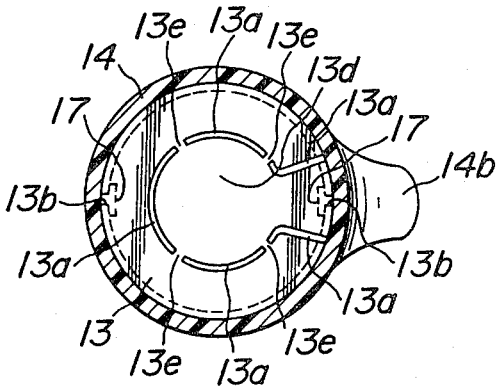
FIG. 5 is a cross sectional view illustrating the sealing aid cut along a line C—C shown in FIG. 4.

Another embodiment of the sealing aid according to the invention will be explained with reference to FIGS. 4 and 5. In this embodiment, portions similar to those of the above-described embodiment disclosed in FIGS. 2A and 2B are denoted by the same reference numerals used in FIGS. 2A and 2B. In FIGS. 4 and 5, a rubber plug 12 is inserted into an opening of a reagent container 11 and is covered with a seal cap 13. A peripheral portion of the seal cap 13 is bent corresponding to a flange 11*c* of a neck portion 11*b* of the container 11 so as to clamp the seal cap 13 around the neck 11*b* of container 11. Slit-like lines 13*a* are formed in the upper and side surfaces of the seal cap 13 with interposing connections 13*e* therebetween. Moreover, the seal cap 13 is covered with an outer cap 14 made of elastic material. In the present embodiment, the seal cap 13 and outer cap 14 are connected to each other at two points and the outer cap 14 is provided with a pull portion 14*b* integrally formed therewith. In the seal cap 13 there are formed two holes 13*b* in its side wall at diagonally opposing positions. The outer cap 14 and seal cap 13 are coupled with each other by fusing discs 17 to the outer cap 14 via the holes 13*b* prior to fixing the caps to the container.

Next the operation for removing the sealing aid from the container 11 in the embodiment shown in FIGS. 4 and 5 from the will be explained. The pull portion 14*b* of the outer cap 14 is picked by the finger and pulled up in a direction shown by an arrow. Since the seal cap 13 is fixed to the outer cap 14 at the position near the pull portion 14*b*, the tongue portion 13*d* of the seal cap 13 is raised up along the cutout lines 13*a* formed in the periphery of the seal cap 13 according to the pulling up operation of the outer cap 14. Finally, the tongue portion 13*d* of the seal cap 13 is completely removed from the seal cap 13, and then the remaining portion of the seal cap 13 fixed to the outer cap 14 at the position opposite to the pull portion 14*b* is removed from the container 11 together with the outer cap 14.

In the embodiment shown in FIGS. 4 and 5, since the seal cap 13 is secured to the outer cap 14 at the diagonally opposing positions, it is possible to remove the seal cap 13 from the container 11 by one pulling up operation on the outer cap 14. In addition, since the pull portion 14*b* is formed integrally with the outer cap 14, the finger is not in touch with the cutoff surface of the seal cap 13 made of the thin aluminum plate, and thus it is possible to further reduce the injury caused by such a sharp edge.

According to the invention, since the seal cap is covered with the outer cap made of elastic material and is connected to the outer cap partially, at least a part of the seal cap can be removed from the container together with the outer cap, when the outer cap is removed from the container. Therefore, the possibility of injury caused by the seal cap made of the metal or the rigid plastic can be materially reduced. In addition, since the connection holding the tongue portion to the edge of the seal cap is automatically broken when the tongue is pulled in a vertical direction it is not necessary to use any special tool for cutting. Moreover, since the outer cap is made of elastic material and has a little larger radius than that of the main body of reagent container, the containers can be effectively protected against damage due to mutual contact during transportation. Further, the plug inserted into the opening of the container is sealed doubly by the seal cap and the outer cap, and thus the sealing function can be further improved.

The present invention is not limited to the embodiments explained above, but many modifications and alterations can be conceived by those skilled in the art within the scope of the invention. For instance, in the embodiment shown in FIGS. 2A and 2B, the Δ marks may be deleted. Even in such a case, the user can easily find a portion of the outer cap upon which his finger is to be put with the aid of the pattern of the ridge-like projections formed in the seal cap. Moreover, the ridge-like projections may be replaced by the slit-like lines.

What is claimed is:

1. A sealing aid for fastening an elastic plug inserted into an opening of a container having a neck portion and a main body connected to the neck portion comprising a seal cap means made of relatively hard material and being connectable to the neck portion of the container in such a manner that a peripheral portion of said seal cap means is bent corresponding to an outer contour of the neck portion of the container so as to fix said seal cap means to said container to prevent the plug from being removed from the container; which seal cap means has a cutout line defining a tongue portion, and an outer cap means made of elastic material and connected partially to said seal cap means, said outer cap means covering the seal cap means;

whereby said seal cap means is connected to said outer cap means at two diagonally opposing positions, one position situating within the tongue portion and the other position situating outside the tongue portion, whereby when the outer cap means is removed from the container, all the seal cap means is removed from the container together with the outer cap means only by a single operation.

2. A sealing aid according to claim 1 wherein said seal cap and outer cap means are connected to each other by means of a hole formed in the seal cap means and a disc coupled with the outer cap means by means of said hole.

3. A sealing aid according to claim 1, wherein said outer cap means comprises a pull portion integrally formed therewith at a side wall of the outer cap means.

4. A sealing aid according to claim 1, wherein said outer cap means has a radius larger than that of the main body of container.

* * * * *